US007554315B2

(12) United States Patent
Wang

(10) Patent No.: US 7,554,315 B2
(45) **Date of Patent: *Jun. 30, 2009**

(54) METHOD AND APPARATUS FOR ADJUSTING A REFERENCE

(75) Inventor: Zhao-Jun Wang, San Jose, CA (US)

(73) Assignee: Power Integrations, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/135,087

(22) Filed: Jun. 6, 2008

(65) Prior Publication Data

US 2008/0238401 A1 Oct. 2, 2008

Related U.S. Application Data

(63) Continuation of application No. 11/493,504, filed on Jul. 25, 2006, now Pat. No. 7,397,231.

(51) Int. Cl.
*G05F 3/16* (2006.01)
*G05F 1/10* (2006.01)

(52) U.S. Cl. ..... 323/315; 323/314

(58) Field of Classification Search ..... 323/304, 323/311, 312, 313, 314, 315; 327/534, 535, 327/537, 538

See application file for complete search history.

(56) References Cited

U.S. PATENT DOCUMENTS

| | | | | |
|---|---|---|---|---|
| 5,187,387 | A | 2/1993 | Kawauchi | |
| 5,675,243 | A | 10/1997 | Kamata | |
| 6,160,393 | A * | 12/2000 | Ahn et al. | 323/315 |
| 7,129,683 | B2 | 10/2006 | Haider et al. | |
| 7,397,231 | B2 * | 7/2008 | Wang | 323/315 |

FOREIGN PATENT DOCUMENTS

DE 4119917 1/1992

OTHER PUBLICATIONS

European Search Report, EP Application No. 07252901.9, Oct. 8, 2007.

* cited by examiner

*Primary Examiner*—Gary L Laxton
(74) *Attorney, Agent, or Firm*—Blakely Sokoloff Taylor & Zafman LLP

(57) ABSTRACT

A circuit includes a current divider to divide a current from a current source into a first current and a reference current. The circuit also includes a current mirror coupled to the current divider to receive the first current from the current divider and to receive an adjustment current. The adjustment current is to set the reference current.

27 Claims, 5 Drawing Sheets

METHOD AND APPARATUS FOR ADJUSTING A REFERENCE

REFERENCE TO PRIOR APPLICATION

This application is a continuation of and claims priority to U.S. application Ser. No. 11/493,504, filed Jul. 25, 2006, entitled "Method and Apparatus for Adjusting a Reference," now pending.

BACKGROUND

1. Field of the Disclosure

The present invention relates generally to electrical circuits and, more specifically, the present invention relates to adjusting a reference in an electrical circuit.

2. Background Information

Integrated circuit controllers for switching power supplies use references such as reference voltages and reference currents to detect when internal and external parameters reach particular values. For example, a signal that senses a current in a switch is sometimes compared to a reference in order for a controller to switch off a power switch when the current exceeds a maximum value. Or, a signal proportional to a duty ratio may be compared to a reference so the controller can prevent the duty ratio from exceeding a maximum value. In another example, a signal proportional to an input voltage is compared to a reference to disable operation of a circuit when the input voltage is too high or too low.

Oftentimes, a reference current or reference voltage needs to be adjusted for a particular application or a transient operating condition. In many cases, the reference needs to be changed in response to an external component or a dynamic stimulus. In addition, it is often desirable to adjust the reference between two values. Known techniques, however, for providing an integrated circuit solution can be costly.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION

Examples of a circuit and method for adjusting a reference such as a reference current or a reference voltage are disclosed herein. In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

In one aspect of the present invention, a circuit includes a current divider and a current mirror. In one example, the current divider may divide a current from a current source into a first and a second reference current. The current mirror may be coupled to receive the first current from the current divider and an adjustment current, in an example. The adjustment current may set the reference current in the circuit and a resistor may be coupled to receive the reference current from the current divider to provide a reference voltage, in the example. Furthermore, in the example, the reference current and a reference voltage may be adjustable between two values, such as, for example, a full value of the reference current or voltage and a fraction of the full value of the reference current or voltage.

Figure 1:
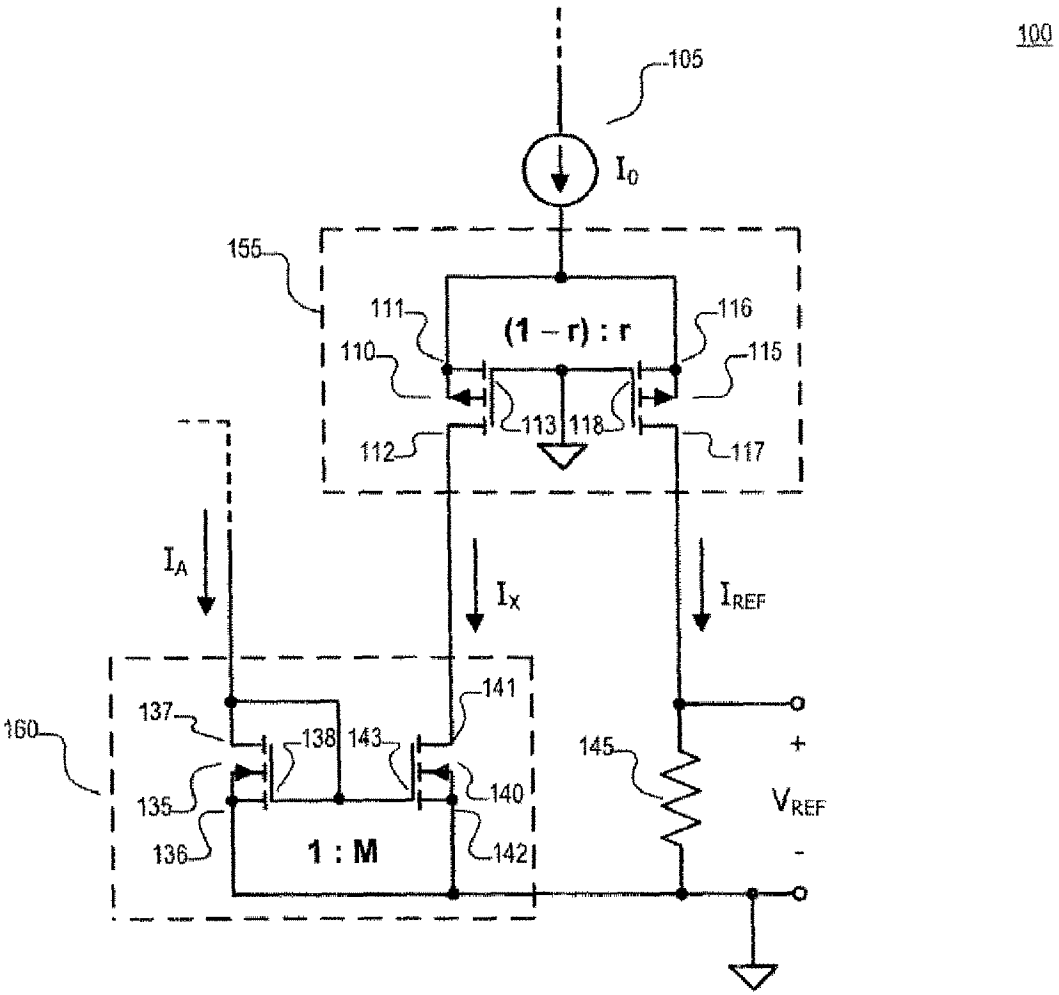
FIG. 1 is a schematic diagram illustrating a circuit according to one embodiment of the present invention.

Shown schematically in FIG. 1 is a circuit 100 including a current divider 155 coupled to a current mirror 160, according to an example. As shown, current divider 155 may include a first transistor 110 including a first, second and third terminal 111, 112 and 113, respectively, and a second transistor 115 including a first, second and third terminal 116, 117 and 118, respectively. In the example, a first terminal 111 of first transistor 110 may be coupled to a first terminal 116 of second transistor 115. In the example a current source 105 may be coupled to first transistor 110 and second transistor 115.

In addition, in the example, a third transistor 135 including a first, second and third terminal 136, 137 and 138, respectively, and a fourth transistor 140 including a first, second and third terminal 141, 142 and 143, respectively, are included in current mirror 160. As illustrated in the example, second terminal 112 of first transistor 110 may be coupled to first terminal 141 of fourth transistor 140, thus coupling current mirror 160 to current divider 155. Note that in the example, transistors 110, 115, 135 and 140 of circuit 100 may include a metal oxide semiconductor field effect transistor (MOSFET). In addition, third transistor 135 and fourth transistor 140 may have respective strengths of the ratio 1:M, in the example.

In operation, current divider 155 may divide a source current or current $I_0$ from a current source 105 into a first current $I_X$ to be output from first transistor 110 and a second current or reference current $I_{REF}$ to be output from second transistor 115. In the example, first and second transistors 110 and 115 may have respective strengths related by a ratio of (1−r):r, where r is less than 1. Accordingly, in the example, a sum of first current $I_X$ and reference current $I_{REF}$ may be substantially equal to a full value of the source current from current source 105 or current $I_0$.

In the example, current mirror 160 may be coupled to current divider 155 to receive first current $I_X$ at first terminal 141 of third transistor 140. In the example, current mirror 160 may also be coupled to receive an adjustment current $I_A$ at second terminal 137 of third transistor 135. Thus, in an example, adjustment current $I_A$ may be mirrored to first current $I_X$. Accordingly, in the example, reference current $I_{REF}$ may be adjusted in response to adjustment current $I_A$. In particular, adjustment current $I_A$ may set reference current $I_{REF}$ to an adjusted value between a full value of reference current $I_{REF}$ and a fraction, r, of the full value of the reference current $I_{REF}$. Furthermore, in the example, a resistor 145 may be coupled to second terminal 117 of second transistor 115 to receive reference current $I_{REF}$ from current divider 155 to provide a reference voltage $V_{REF}$. Note that in various examples, adjustment current $I_A$ may originate either inside or outside an integrated circuit that may contain circuit 100. In one example, the integrated circuit may control a power supply.

Figure 2:
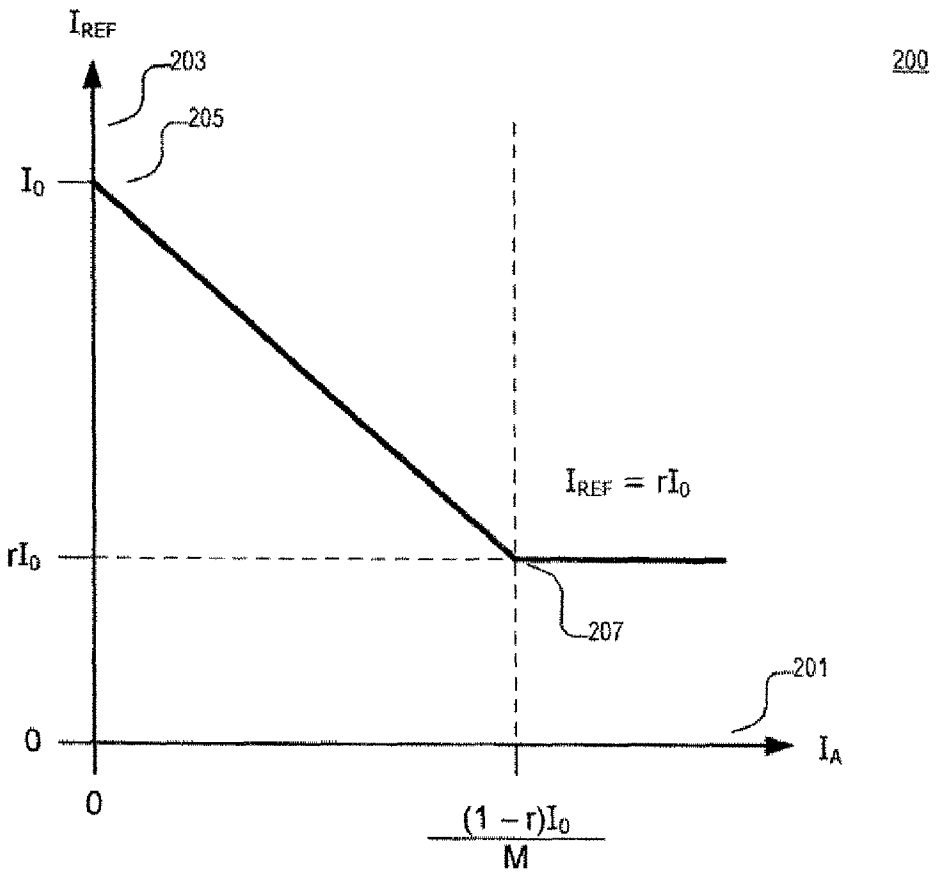
FIG. 2 is a graph associated with the circuit of FIG. 1.

FIG. 2 is a graph 200 depicting the relationship between adjustment current $I_A$, indicated on a horizontal axis 201, and reference current $I_{REF}$, indicated on vertical axis 203. As illustrated in FIG. 2, a change in adjustment current $I_A$ and reference current $I_{REF}$ may be substantially linear or proportional when adjustment current $I_A$ is between an upper and a lower threshold value. Accordingly, in the example, when adjustment current $I_A$ is less than or equal to a lower threshold value such as 0, as in the example of FIG. 2, reference current $I_{REF}$ is substantially equal to current $I_0$, which is a full value 205 of reference current $I_{REF}$. Because the sum of first current $I_X$ and reference current $I_{REF}$ substantially equals current $I_0$, when reference current $I_{REF}$ is at full value 205, first current $I_X$ is equal to 0 (not shown), in the example.

Note that first current $I_X$ is the lesser of either mirrored adjustment current $MI_A$ or current $(1-r)I_0$, in the example. Accordingly, in the example, because first current $I_X$ may not exceed $(1-r)I_0$, adjustment current $I_A$ may not reduce reference current $I_{REF}$ to less than a fractional value $rI_0$. Thus, as shown in graph 200, as adjustment current $I_A$ increases, reference current $I_{REF}$ may decrease proportionally until it reaches fractional value $rI_0$ at 207 and first current $I_X$ is equal to current $(1-r)I_0$. In the example, adjustment current $I_A$ is then greater than or equal to the upper threshold value, $(1-r)I_0/M$, in the example of FIG. 2. Note also, in the example, resistor 145 may receive reference current $I_{REF}$ to produce a reference voltage $V_{REF}$.

Figure 3:
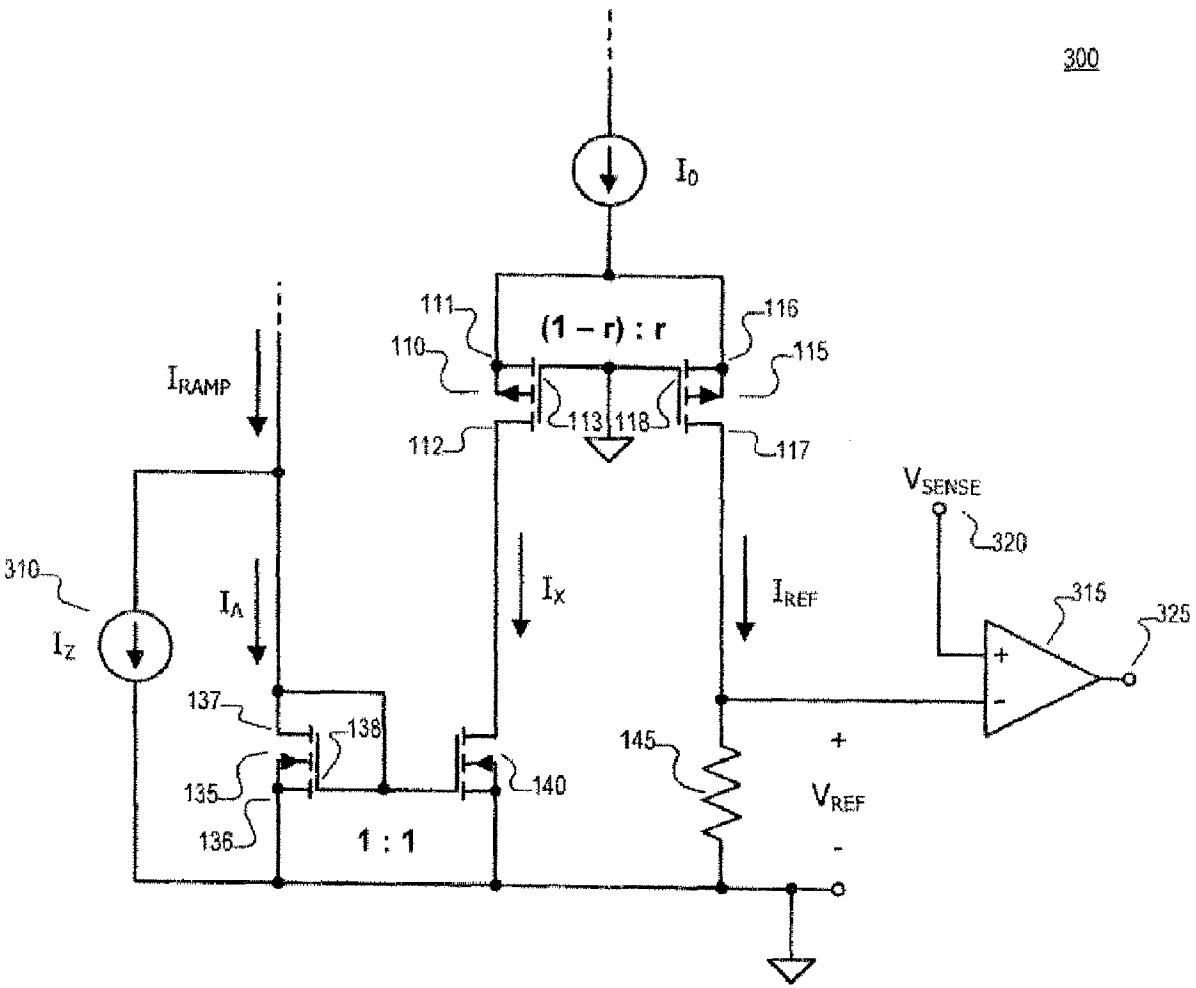
FIG. 3 is a schematic diagram illustrating a circuit according to one embodiment of the present invention.

FIG. 3 illustrates an example circuit 300 associated with an implementation of circuit 100 (FIG. 1), in an example. In the example, circuit 300 may adjust a reference voltage $V_{REF}$ between a full value $V_0$ to a fraction of a full value $rV_0$ as a function of time. Circuit 300 may include a comparator 315 coupled to compare a sensed voltage $V_{SENSE}$ to reference voltage $V_{REF}$ to set an output 325 to a logic high value when a sensed voltage $V_{SENSE}$ exceeds reference voltage $V_{REF}$, in accordance with an example. Circuit 300 may also include an input current source 310 coupled to first and second terminal 136 and 137 of third transistor 135 and coupled to receive an input current $I_{RAMP}$, in the example. In the example, input current source 310 may remove a first threshold current $I_Z$ from input current $I_{RAMP}$ to produce adjustment current $I_A$.

Figure 4:
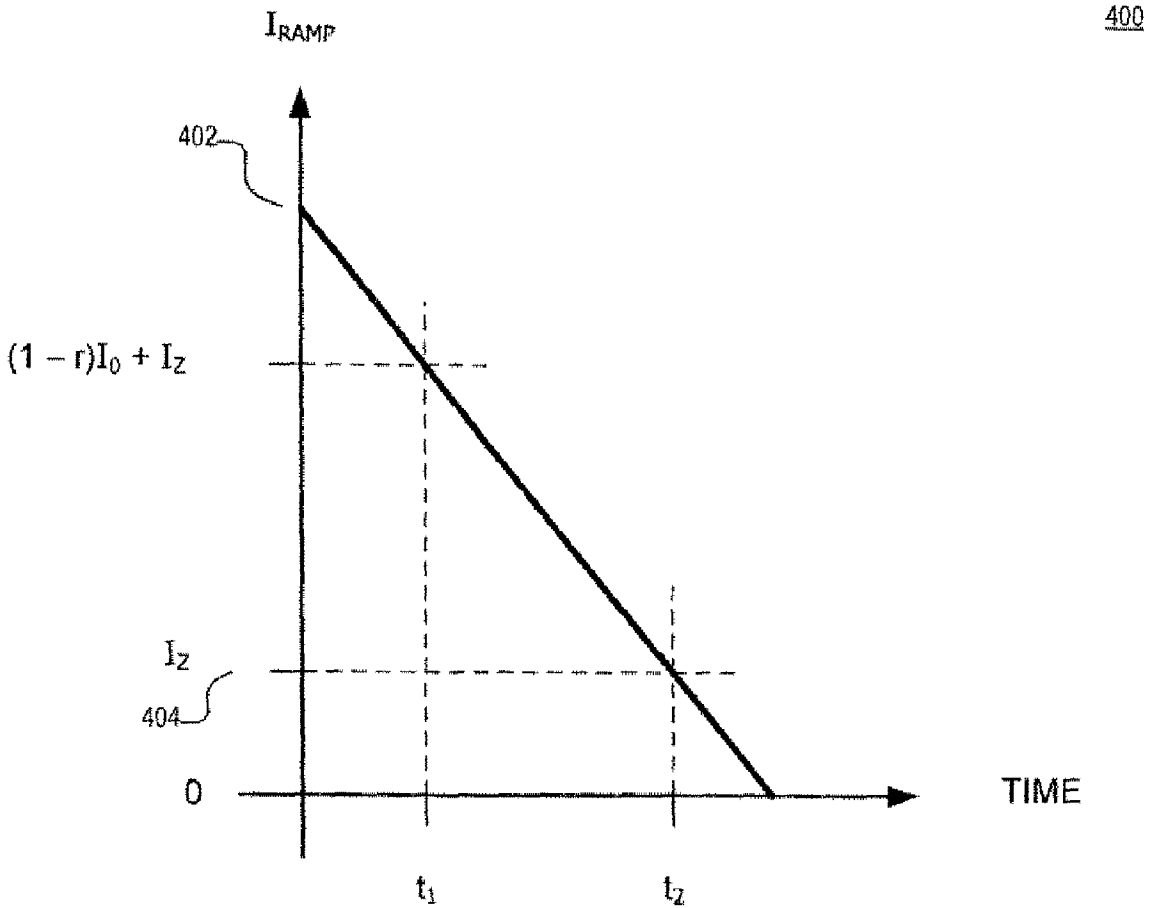
FIG. 4 is a graph associated with the circuit of FIG. 3.

FIG. 4 is a graph 400 of input current $I_{RAMP}$ as a function of time, during operation of circuit 300 of FIG. 3, in an example. As shown, in the example, input current $I_{RAMP}$ may decrease linearly with time from a value 402 that is greater than $(1-r)I_0$ plus a first threshold current $I_Z$, for times less than $t_1$, to a value that is less than first threshold current $I_Z$, at 404 for times greater than $t_2$. In the example, input current source 310 of FIG. 3 may reduce input current $I_{RAMP}$ by first threshold current $I_Z$ to produce adjustment current $I_A$. In the example of FIG. 3, the strengths of transistors 135 and 140 may be equal, corresponding to M=1 in current mirror 160 of FIG. 1. In various examples, first threshold current $I_Z$ may have a small value such as for example, approximately one microampere, to offset leakage current in $I_{RAMP}$. As a result, the presence of first threshold current $I_Z$ may help to ensure that adjustment current $I_A$ goes to a value of zero.

Figure 5:
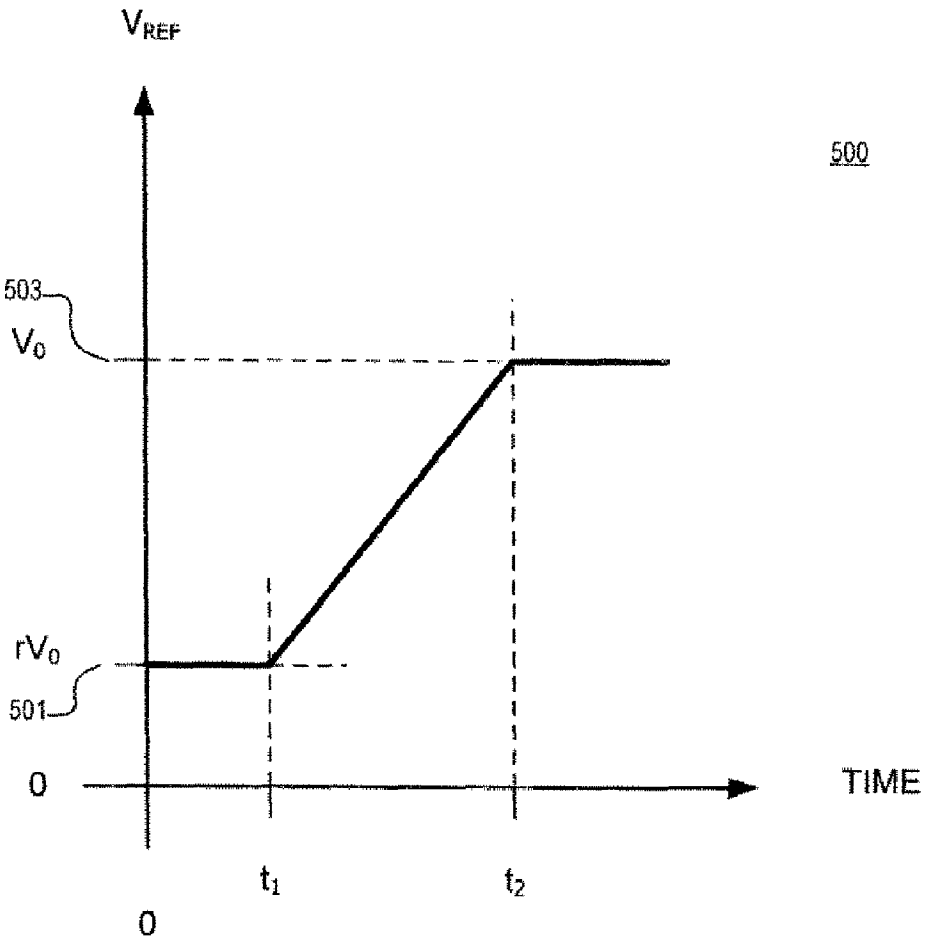
FIG. 5 is a graph associated with the circuit of FIG. 3.

FIG. 5 further illustrates the adjustability of reference voltage $V_{REF}$ between two values, in an example. Graph 500 shows reference voltage $V_{REF}$ of circuit 300 (FIG. 3) as a function of time, in an example. Reference voltage $V_{REF}$ may be generated from reference current $I_{REF}$ and may therefore have a fractional value $rV_0$ at 501 for times less than $t_1$, rise substantially linearly from $rV_0$ to a full value $V_0$ at 503, between time $t_1$ and $t_2$, in the example. In the example, reference voltage $V_{REF}$ may then remain substantially at full value $V_0$ for times greater than $t_2$.

In an example, parameters in the example circuits of FIGS. 1 and 3 may be controlled by design of circuits 100 and 300. In particular, in an example, the values of current $I_0$ of current source 105, first threshold current $I_Z$ and fractional value r may determine a first and a second value of reference voltage $V_{REF}$ or a full value and a fraction of a full value of reference voltage $V_{REF}$. In various examples, such values may be set with geometric ratios or by trimming on an integrated circuit.

In the foregoing detailed description, the method and apparatus of the present invention has been described with reference to specific exemplary embodiments thereof. It will, however, be evident that various modifications and changes may be made thereto without departing from the broader spirit and scope of the present invention. The present specification and figures are accordingly to be regarded as illustrative rather than restrictive.

What is claimed is:

1. A reference adjust circuit comprising:

a current mirror that receives an adjustment current and a first current proportional to the adjustment current;

a current divider that divides a source current into the first current and a reference current, wherein a change in reference current is proportional to a change in adjustment current when adjustment current is between an upper and a lower threshold value; and a substantially resistive component coupled to the current divider that converts the reference current to a reference voltage, wherein the reference voltage is proportional to the change in adjustment current.

2. The reference adjust circuit of claim 1 is included in an integrated circuit.

3. The reference adjust circuit of claim 1 wherein a minimum value of the reference current is limited by the current divider.

4. The reference adjust circuit of claim 3 wherein the current divider limits the reference current to the minimum value in response to a current divider ratio and the source current.

5. The reference adjust circuit of claim 1 wherein a maximum value of the reference current is substantially equal to the source current.

6. The reference adjust circuit of claim 1 wherein the current divider further includes a current mirror.

7. The reference adjust circuit of claim 1 wherein the current divider consists of a first transistor and a second transistor configured as a current mirror.

8. The reference adjust circuit of claim 1 wherein the substantially resistive component consists of a resistor.

9. The reference adjust circuit of claim 1, wherein the reference adjust circuit is configured to adjust the reference voltage between a full voltage value and a fraction of the full voltage value.

10. The reference adjust circuit of claim 9, wherein the full voltage value and the fraction of the full voltage value may be determined by the source current and a current divider ratio of the current divider.

11. The reference adjust circuit of claim 1, further comprising a comparator coupled to the current divider which is configured to receive the reference voltage, wherein the comparator is further configured to receive a sense voltage and output a control signal when the sense voltage is greater than the reference voltage.

12. The reference adjust circuit of claim 1, wherein an input current is the sum of the adjustment current and a first current threshold.

13. The reference adjust circuit of claim 12, wherein the reference adjust circuit adjusts the reference voltage between a full voltage value and a fraction of the full voltage value, wherein the full voltage value and the fraction of the full voltage value may be determined by the source current, a current divider ratio of the current divider, and the first current threshold.

14. The reference adjust circuit of claim 12, wherein the input current adjusts between the sum of the first threshold current and a portion of the source current and the first threshold current.

15. A reference adjust circuit comprising:

a current mirror that receives an adjustment current and a first current proportional to the adjustment current, wherein the adjustment current is the result of the difference between an input current and a first source current, wherein the input current changes linearly during a time duration;

a current divider that divides a source current into the first current and a reference current, wherein the reference current changes substantially linear during the time duration in response to the input current; and a substantially resistive component coupled to the current divider that converts the reference current to a reference voltage, wherein the reference voltage is proportional to the change in adjustment current.

16. The reference adjust circuit of claim 15 is included in an integrated circuit.

17. The reference adjust circuit of claim 15 wherein a minimum value of the reference current is limited by the current divider.

18. The reference adjust circuit of claim 17 wherein the current divider limits the reference current to the minimum value in response to a current divider ratio and the source current.

19. The reference adjust circuit of claim 15 wherein a maximum value of the reference current is substantially equal to the source current.

20. The reference adjust circuit of claim 15 wherein the current divider further includes a current mirror.

21. The reference adjust circuit of claim 15 wherein the current divider consists of a first transistor and a second transistor configured as a current mirror.

22. The reference adjust circuit of claim 15 wherein the substantially resistive component consists of a resistor.

23. The reference adjust circuit of claim 15, wherein the reference adjust circuit is configured to adjust the reference voltage between a full voltage value and a fraction of the full voltage value during the time duration.

24. The reference adjust circuit of claim 23, wherein the reference voltage is the fraction of the full voltage value prior to the time duration.

25. The reference adjust circuit of claim 23, wherein the reference voltage is substantially the full voltage value after the time duration.

26. The reference adjust circuit of claim 23, wherein the full voltage value and the fraction of the full voltage value may be determined by the source current and a current divider ratio of the current divider.

27. The reference adjust circuit of claim 15, further comprising a comparator coupled to the current divider which is configured to receive the reference voltage, wherein the comparator is further configured to receive a sense voltage and output a control signal when the sense voltage is greater than the reference voltage.

* * * * *